US005080153A

United States Patent [19]

Waterman

[11] Patent Number: 5,080,153

[45] Date of Patent: Jan. 14, 1992

[54] BLADE ADJUSTING MEANS FOR THE CUTTER HEADS OF WOOD CHIPPERS

[76] Inventor: Carl D. Waterman, P.O. Box 349, Main Street, Waldoboro, Me. 04572

[21] Appl. No.: 644,112

[22] Filed: Jan. 18, 1991

[51] Int. Cl.[5] ..... B27C 1/00

[52] U.S. Cl. ..... 144/176; 144/162 R; 241/92; 241/298

[58] Field of Search ..... 144/162 R, 176, 241, 144/218; 241/92, 298

[56] References Cited

U.S. PATENT DOCUMENTS

| | | | |
|---|---|---|---|
| 2,337,407 | 12/1943 | Ottersland | 144/212 |
| 2,570,845 | 10/1951 | Ottersland | 144/176 |
| 2,825,371 | 3/1958 | Forman | 241/92 X |
| 3,011,535 | 12/1961 | Andrus et al. | 144/241 |
| 3,856,212 | 12/1974 | Swatko | 144/176 |
| 3,976,271 | 8/1976 | Larsson et al. | 241/298 |

*Primary Examiner*—W. Donald Bray

*Attorney, Agent, or Firm*—Abbott Spear

[57] ABSTRACT

A cutter head for a wood chipper has a circular disc and is mounted on a spindle by which the cutter head is rapidly rotated. The disc has at least one knife detachably connected thereto with its cutting edge exposed on the face of the disc engaged by the lengths of wood to be chipped. The connecting means comprise an actuating member releaseably seated against the rear face of the disc in a manner such that it may be moved parallel to the slot through which the knife extends. The knife is releaseably connected to the disc to enable its cutting edge to be advanced or retracted relative to the face of the disc engaged by lengths of wood and is also connected to the actuating member in a manner such that movements of the actuating member in either direction parallel to the knife receiving slot are attended by corresponding movements of the knife in directions normal to movements of the actuating member.

10 Claims, 3 Drawing Sheets

BLADE ADJUSTING MEANS FOR THE CUTTER HEADS OF WOOD CHIPPERS

BACKGROUND OF THE INVENTION

The cutter heads of wood chippers are provided with one or more blades which are detachable so that they may be sharpened and replaced.

As blade resharpening results in the reduction in blade width, compensation for such a change in width is required. Insofar as it is known, such compensation has required, prior to the present invention, either the adjustment of a series of set screws spaced lengthwise of the backing edge of the blade appropriately for contact with the backing surface or the filling of the space then resulting between the backing edge of the blade and the backing surface by means of shims or by molten lead. Some inexpensive machines make no provisions by which wear may be compensated for.

In addition, where a cutter head is provided with only one knife or some other non-symmetrical knife arrangement, the loss in weight of a resharpened blade presents a problem since the balance of the cutter head is lost as the blade is consumed by resharpening. The adjustment of knives to compensate for the results of resharpening in the ways previously referred to require some skill and are time consuming and the use of molten lead is both cumbersome and inconvenient.

Chippers commonly use cutter heads having a symmetrically arranged set of knives to counter loss of balance and it is necessary to keep the knives in sets and to sharpen and adjust them evenly to maintain that balance.

THE PRESENT INVENTION

The general objective of the present invention is to provide a cutter head construction which enables a resharpened blade to be brought into a wanted set position conveniently and at the same time appropriately backed and, in applications where the cutter head has an unbalanced knife arrangement, to provide that such an adjustment is also automatically attended by the reestablishment of the balance of the cutter head.

In accordance with the invention, these objectives are attained by means of a connection between the knife and the cutter head which holds the knife with its cutting edge extending outwardly through a slot in the cutter head into an operative position relative to the front or working face thereof.

The connection includes an adjustable actuating member and a clamping member between which the knife is held. The clamping member is bolted to the cutter head against the trailing edge of the knife-receiving slot with the bolts extending through parallel slots in the knife which are normal to its cutting edge. The actuating member is separately attached to the rear face of the cutter head in a manner enabling it to be clamped against it or slid relative thereto in directions paralleling the knife-receiving slot. The knife and the actuating member are interconnected in a manner such that sliding movements of the actuating member are attended by proportioned movements of the knife in directions normal thereto with the actuating member serving as a backing member for the knife. Such sliding movements are effected as by a rotatable adjusting member held captive on the rear face of the cutter head and having a threaded connection with the actuating member. With such a connection, any wanted position of the cutting edge of a knife may be quickly and accurately established.

It is a particular and important objective of the invention, particularly where the cutter head is provided with a single knife or an unsymmetrical knife arrangement, that the adjusting member be effective to move the backing member lengthwise of the knife-receiving slot towards the periphery of the cutter head to an extent compensating for the weight of metal lost during resharpening thereby to reestablish the balance of the cutter head which otherwise would be lost.

A particular advantage of the invention is in its use with a cutter head provided with a single knife for there are several advantages inherent in such a cutter head. Where horse power is limited, a one knife cutter head can chip larger diameter material than one employing a plurality of knives as the length of the knife may be that of the radius of the cutter head and the knife receiving slot may and preferably does open through the periphery of the cutter head. This is not true with most multiple knife cutter heads.

With a single full length knife, the entire kinetic energy of the cutter head is concentrated in a single cut rather than in a plurality of cuts and fewer cuts per revolution are taken when any given cutting speed is maintained thus requiring less horse power. In addition, the structured integrity of the knife supporting circular portion of the cutter head is maintained with a cutter head designed for use with a single knife. Such a cutter head is unlike a cutter head using two or more knives which require extra reenforcement, or other design compromises, which add weight, bulk or both. A full length knife cuts more efficiently than half length knives and an open ended slot is less likely to plug up with chips than closed ended slots. Cutter heads having single full length knives are well suited for use in portable chippers.

BRIEF DESCRIPTIONOF THE DRAWINGS

The accompanying drawings illustrate a preferred embodiment of the invention and FIG. 1 is an edge view of a cutter head in accordance therewith;

THE PREFERRED EMBODIMENT

Figure 1:
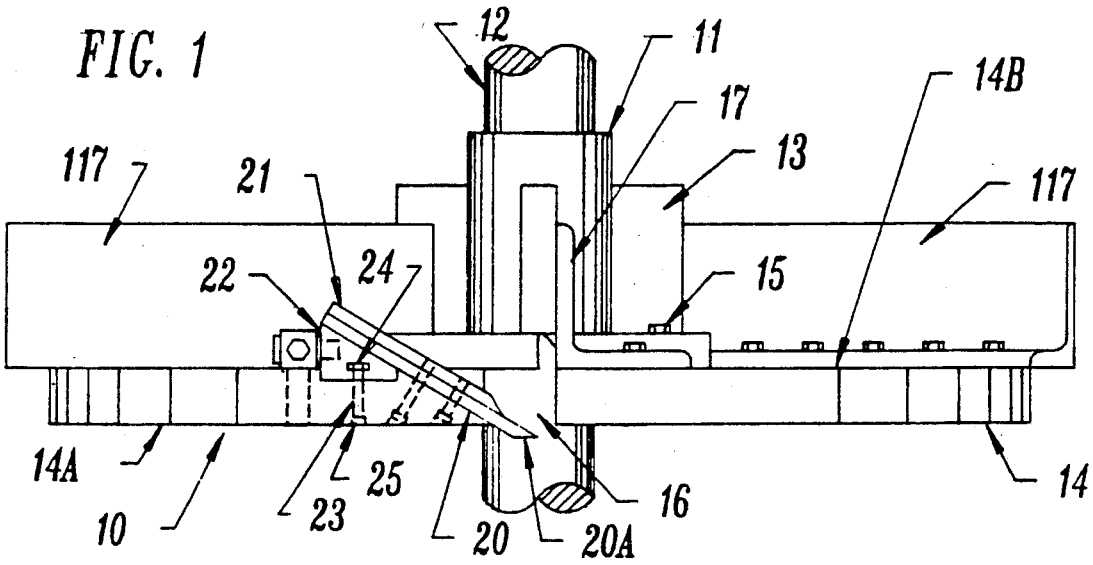
Figure 2:
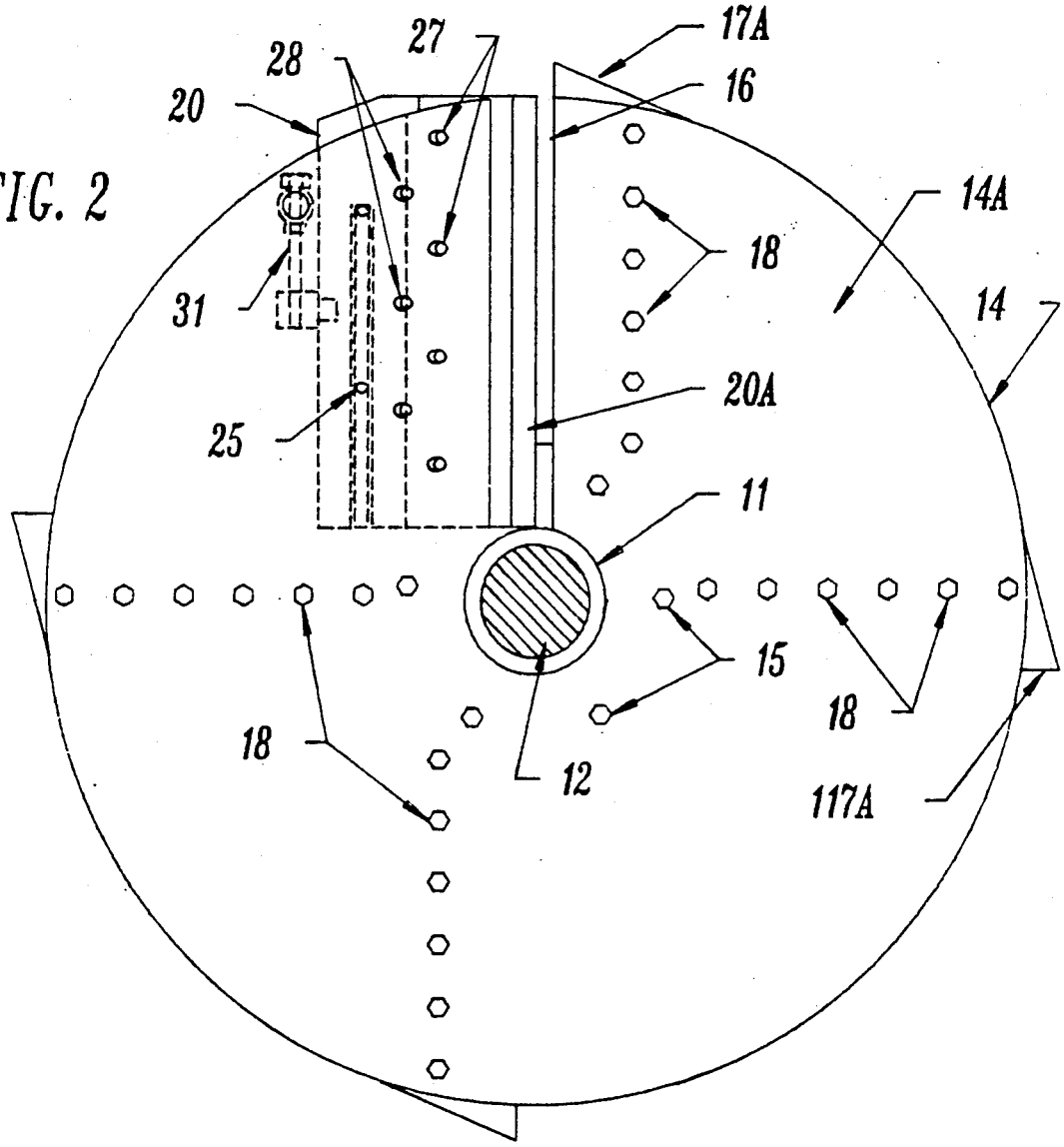
FIG. 2 is a view of the front or working face of the cutter head.
Figure 3:
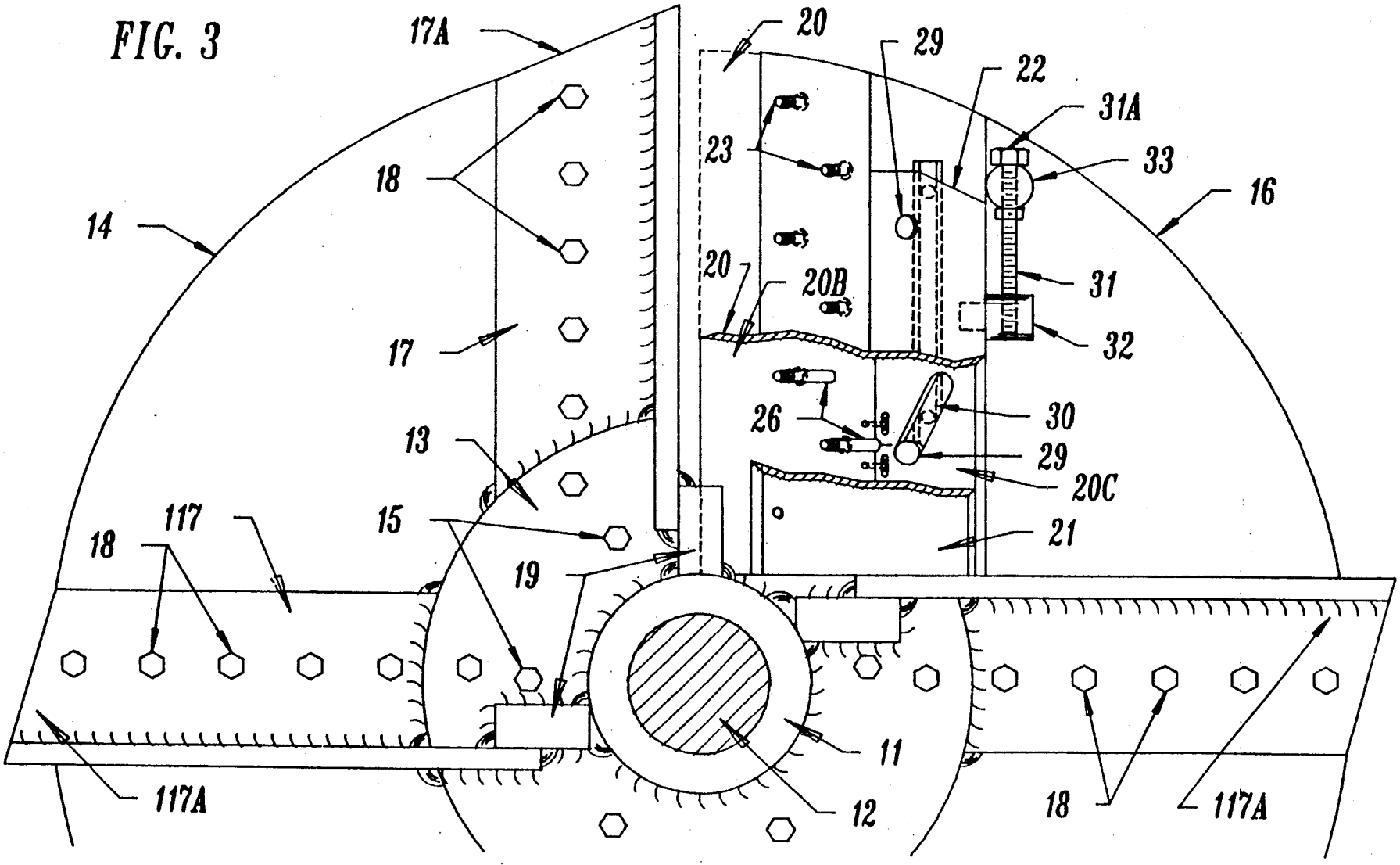
FIG. 3 is a fragmentary view, on an increase in scale of the rear face of the cutter head.

The embodiment of the invention illustrated by the drawings has a cutter head, generally indicated at 10 mounted on a boss 11 formed on a spindle 12. The spindle 12 is conventionally journalled in bearings, not shown, and serves as the drive shaft by which the cutter head is rotated in the direction of the arrow A at a suitable chipping rate, 1000 RPM by way of example and not of limitation.

A support 13, shown as arcuate with respect to the spindle axis and slightly more than 270° in extent, is welded to the boss 11 and a disc, generally indicated at 14, is secured against the forward or outer face of the support 13 by bolts 15. The disc 14 has a straight, substantially radial slot 16 extending from its inner edge to and through the periphery thereof.

The front or working face of the disc 14 is indicated at 14A and its rear face at 14B. The leading edge of the slot 16 is bordered by a reenforcing member 17 of right angular cross section having one wall secured against the rear face 14B by a series of bolts 18. Like members 117 are similarly secured to the rear face 14B and are spaced equal distances apart from the member 17 and each other. The outer ends of the members 17, 117 extend slightly beyond the periphery of the disc 14 and are bevelled with the bevelled ends 117A of the two opposite members 117 inclined downwardly in the trailing direction and the bevelled end 17A and the opposite end 117A oppositely inclined with the outer ends all functioning as a fan to impel cut chips and effect their discharge from the chipper. The inner ends of the other walls of the members 17, 117 are welded to supports 19 secured to the boss 11.

In the illustrated embodiment of the invention, a single chipping knife, generally indicated at 20, is shown as such illustrates not only blade adjustments generally but also the problem where a single knife or other unbalanced knife arrangement is employed. The knife 20 has an adjustable connection with the rear face 14B of the cutter head holding the blade with its cutting edge 20A protruding from the front face 14A at an appropriate cutting angle and to a selected extent in order to cut chips of wanted size from lengths of wood fed against the disc face 14A.

The connection between the knife 20 and the disc 14 comprises a clamping member 21 and an actuating member 22. The actuating member 22 is seated against the disc face 14B and is releaseably held against it by bolts 23 which extend through the disc 14 with their heads exposed in sockets in the disc face 14A. The bolts 23 are threaded into tapped holes in a T-shaped bar 24 which is a slidable fit in a T-shaped slot 25 extending lengthwise of the actuating member 22. In practise, the bar 24 is of the same length as the actuating member which is somewhat shorter than the knife 20 which extends the full length of the slot 16. The actuating member is shown as wedge shaped with its exposed surface and the bevelled trailing margin of the slot 16 establishing the seat against which the knife 20 is held at the appropriate cutting angle.

The knife 20 is shown as consisting of two sections, the outer or front section 20B, which includes the cutting edge 20A, and a rear section 20C. The knife is provided with two series of parallel slots 26 disposed normal to the cutting edge 20A and the disc 14 has two series of bores, which are normal to the knife when connected to the disc 14 and to the clamping member 21 and have their outer ends counter bored to provide sockets accommodative of the heads of bolts, the bolts 27 for one series of bores and shorter bolts 28 for the other series. The bolts extend through the slots 26 and into tapped holes in the clamping member 21. When the bolts 27, 28 are released, the knife can be positioned so as to place its cutting edge 20A the wanted distance from the disc face 14A and, when then tightened, firmly hold the knife 20 in place.

Figure 4:
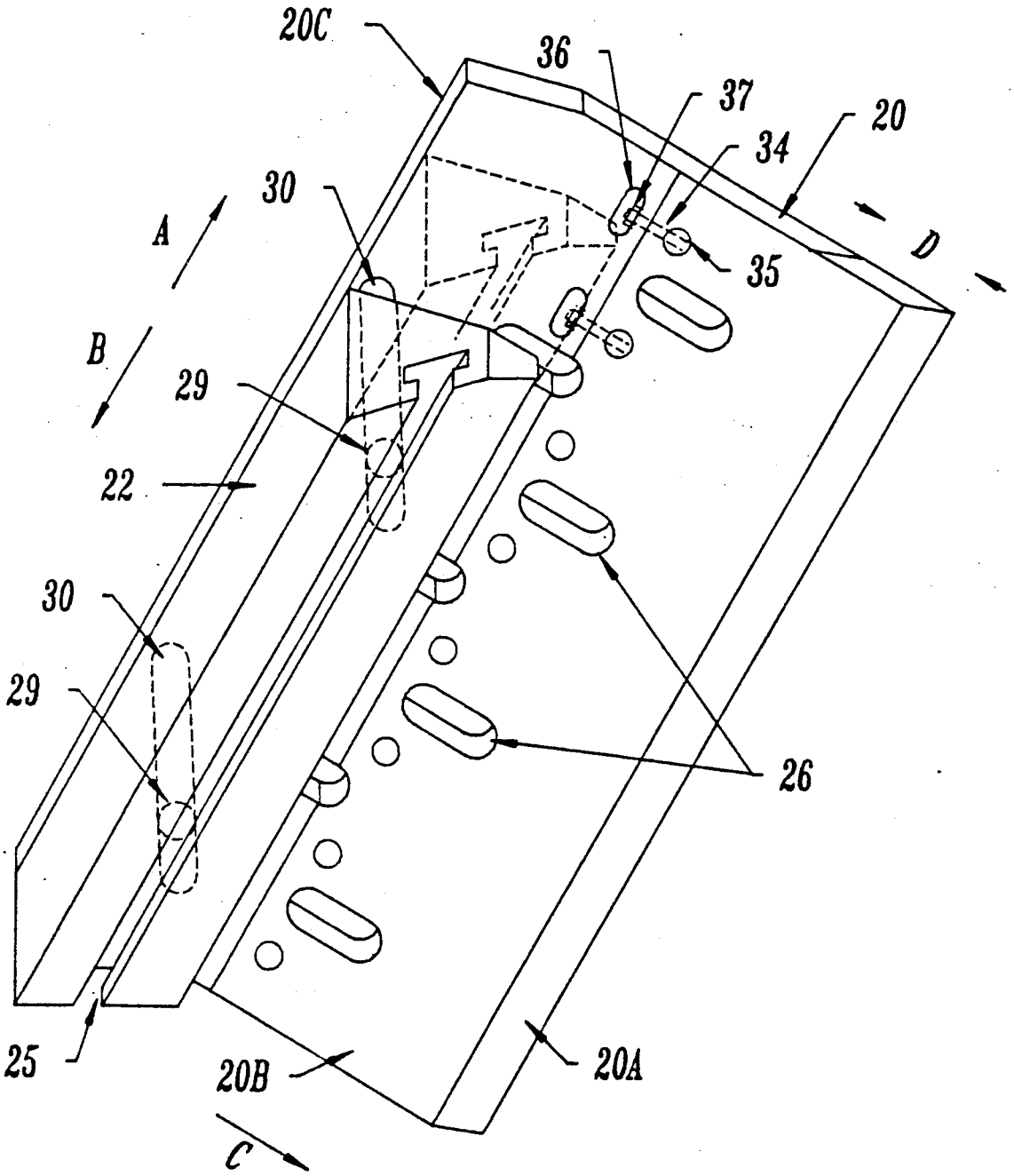
FIG. 4 is a perspective view, on a further increase in scale, of the actuating member and the knife.

The actuating member 22 is shown as provided with two posts or pins 29 which are normal to its face against which the knife 20 is held and each is entrant of the appropriate one of the parallel slots 30 in the knife section 20C which are so angularly inclined that movement of the actuating member in the direction of the arrow B, see FIG. 4, advances the knife or in the opposite direction, retracts it, in either case when clamping pressure on the knife is released.

Such movements of the actuating member 22 are effected by means of finely threaded adjusting screw 31 threaded through a stem 32 on to the larger end of the actuating member 22 and rotatably held captive by a holder 33 exposed on the disc face 14B adjacent the periphery of the disc so that its exposed end 31A is easily engaged by a suitable tool and turned in one direction or the other to advance or retract the cutting edge 20A.

In use, the knife 20 may be sharpened without being detached from the disc 14. After being resharpened, the clamping bolts 23, 27 and 28 are loosened to enable the newly established cutting edge to be repositioned by rotating the adjusting screw 31 in a direction to advance the blade which results in the actuating member 22 being advanced towards the periphery of the disc 14. The clamping bolts 23, 27 and 28 are then resecured. Alternatively, the knife 20, the backing member 21 and the actuating member 22 may be removed and disassembled, perhaps replacing the knife with a sharpened one. After being reassembled, the assembly is reattached to the disc 14 and the adjusting screw 31 turned in the appropriate direction to bring the cutting edge 20A into position. Such adjustments simultaneously move the actuating member 22 and where a single or other unsymmetrical knife arrangement is used, the repositioning of the actuating member 22 results in the weight of metal lost from the knife, while being resharpened or added by a new knife, being compensated for and the balance of the disc 14 maintained.

By way of example, in FIG. 4 it is assumed that the metal removed during previous resharpenings of the knife 20 reduces the knife width by the distance D. By turning the adjusting screw 31 to advance the actuating member 22 in the direction of the arrow B after successive resharpenings, the knife has been moved relative to the actuating member 22 in the direction of the arrow C until its cutting edge was correctly positioned with balance of the disc restored.

In the disclosed embodiment of the invention, the knife sections 20B and 20C are separable and are clamped together by studs 34 extending through aligned bores in the abutting margins of the two sections. One end of each stud extends into a cylindrical bore in the knife section 20B accommodating a cylindrical nut 35 into which that stud is threaded while the other end thereof extends into a slot 36 in the section 20C with a nut 37 threaded thereon and so exposed that it may be easily engaged to be tightened or released. This construction has the advantage that steel of different qualities may be employed for each secion in the construction of a knife with a reduction in machining costs of a replacement section.

I claim:

1. A cutter head for a wood chipper, said cutter head including a circular disc having front and rear faces and a substantially radial slot, at least one knife, the knife having parallel cutting and rear edges and a series of transverse, parallel slots between said edges, a drive spindle axially connected to the cutter head with the front face of the disc exposed for engagement by lengths of wood fed against it to be chipped, means mounted on the rear face of the disc holding the knife in a position in which the knife is forwardly inclined and extends through the slot in the disc with its cutting edge, substantially radial, in a cutting position, said means including a knife clamping member releaseably connected to the disc through the knife slots to enable the knife to be advanced, retracted or held in place, and an actuating member releaseably connected to the disc in a manner enabling said actuating member to be moved parallel to the slot in either direction relative to the ends of the slot or locked against movement, and the actuating member also having connection with the knife serving when locked, as a backing member for the knife and, when moved effecting movements of the knife in directions normal to the directions in which the actuating member may be moved.

2. The cutter head of claim 1 in which the connection between the knife and the actuating member consists of pins spaced lengthwise of the actuating member and the knife has parallel slots disposed diagonally with respect to its cutting edge entered by the pins.

3. The cutter head of claim 2 in which the angle of the diagonal slots relative to the cutting edge and to the directions in which the actuating member may be moved is such that movement of the actuating member into its cutting position positions the actuating member to compensate for any change in blade weight whether due to its being resharpened or a replacement blade.

4. The cutter head of claim 1 and manually operable means to effect micro-adjustments of the actuating member.

5. The cutter head of claim 4 in which the actuating means has a stem, a finely threaded member is threaded through the stem, and is connected to the disc to be held captive thereby with an end disposed for tool engagement.

6. The cutter head of claim 1 in which the trailing edge of the knife-receiving slot of the disc is bevelled to provide a first seat for the knife and the exposed face of the actuating member constitutes a second seat for the knife, the two seats in the plane establishing the forwardly inclined knife position.

7. The cutter head of claim 6 in which the actuating member is wedge shaped in cross section and has a T-shaped lengthwise slot opening through its face held against the rear face of the disc.

8. The cutter head of claim 6 in which the clamping member is clamped agains the first seat.

9. The cutter head of claim 1 in which the knife receiving slot opens through the periphery of the disc and the knife extends the full length of the slot.

10. The cutter head of claim 1 in which the knife consists of a front section which includes the cutting edge and a rear section, the sections having abutting edges and means clamping the abutting edges together.

* * * * *